US011641934B2

(12) United States Patent
Samsel

(10) Patent No.: US 11,641,934 B2
(45) Date of Patent: May 9, 2023

(54) VACUUMING BROOM ASSEMBLY

(71) Applicant: Christopher Samsel, N. Bonneville, WA (US)

(72) Inventor: Christopher Samsel, N. Bonneville, WA (US)

( * ) Notice: Subject to any disclaimer, the term of this patent is extended or adjusted under 35 U.S.C. 154(b) by 39 days.

(21) Appl. No.: 17/340,957

(22) Filed: Jun. 7, 2021

(65) Prior Publication Data

US 2022/0386769 A1 Dec. 8, 2022

(51) Int. Cl.

| | |
|---|---|
| ***A46B 15/00*** | (2006.01) |
| ***A47L 5/36*** | (2006.01) |
| ***A47L 9/24*** | (2006.01) |
| ***A47L 9/06*** | (2006.01) |

(52) U.S. Cl.

CPC ..... *A46B 15/0053* (2013.01); *A47L 5/36* (2013.01); *A47L 9/0606* (2013.01); *A47L 9/242* (2013.01); *A46B 2200/302* (2013.01)

(58) Field of Classification Search

CPC ..... A47L 5/36; A47L 9/0606; A47L 9/242; A46B 15/0053; A46B 2200/302

See application file for complete search history.

(56) References Cited

U.S. PATENT DOCUMENTS

| | | | | |
|---|---|---|---|---|
| 5,072,479 | A * | 12/1991 | Van Niekerk | A46B 3/005 15/207.2 |
| 5,432,976 | A * | 7/1995 | Alazet | A47L 7/00 15/350 |
| 5,839,158 | A | 11/1998 | Schupp | |
| 6,029,311 | A | 2/2000 | Scanni | |
| 6,125,500 | A | 10/2000 | Kat | |
| 6,553,610 | B1 * | 4/2003 | Shideler | A47L 5/36 15/327.5 |
| D548,911 | S | 8/2007 | Main | |
| 7,707,683 | B2 | 5/2010 | Nurudeen | |
| 2004/0107529 | A1 * | 6/2004 | Shahbaz | A47L 5/36 15/327.5 |

(Continued)

FOREIGN PATENT DOCUMENTS

| | | | | |
|---|---|---|---|---|
| EP | 2987425 | A2 * | 2/2016 | A46B 15/0053 |
| GB | 2446860 | A * | 8/2008 | A46B 15/0002 |
| WO | WO2006128534 | | 7/2006 | |

OTHER PUBLICATIONS

EP2987425A2 (Kowalewski Klaus) Published on Jun. 28, 2017, translation obtained from Espacenet: https://translationportal.epo.org/emtp/translate?ACTION=description-retrieval&COUNTRY=EP&ENGINE=google&FORMAT=docdb&KIND=B1&LOCALE=en_EP&NUMBER=2987425&SRCLANG=de&TRGLANG=en&apikey=TSMqTfrVAvNtryGI8Qlfbozj8DnAG.*

*Primary Examiner* — Brian D Keller
*Assistant Examiner* — Christopher Soto

(57) ABSTRACT

A vacuuming broom assembly includes a vacuum pack that is wearable on a user's back. The vacuum pack has an intake for urging air inwardly therein when the vacuum pack is turned on and a suction hose is fluidly coupled to the intake. A broom is provided that has a head and a handle. A suction manifold is coupled to the broom and the suction manifold has a pair of inlet ports and an exhaust port. The suction hose is fluidly coupled to the exhaust port such that the suction manifold is in fluid communication with the vacuum unit. Each of the inlet ports is aligned with the head of the broom for sucking up debris that is produced from sweeping. In this way the vacuum unit reduces airborne particles produced from sweeping.

4 Claims, 5 Drawing Sheets

(56) References Cited

U.S. PATENT DOCUMENTS

| | | | | |
|---|---|---|---|---|
| 2010/0132151 | A1* | 6/2010 | Khalil | A47L 9/322<br>15/344 |
| 2018/0271268 | A1 | 9/2018 | Caswell | |
| 2020/0069127 | A1* | 3/2020 | Vallillo | A47L 9/0606 |

* cited by examiner

VACUUMING BROOM ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to vacuuming devices and more particularly pertains to a new vacuuming device for reducing airborne particles from sweeping.

(2) Description of Related Art Including Information Disclosed Under 37 CFR 1.97 and 1.98

The prior art relates to vacuuming devices. The prior art discloses a variety of brooms that include a bristle head and a handle. In each case the handle and the bristle head are hollow, through a variety of designs including internal chambers and internal conduits, such that the handle and the bristle head can pass air therethrough. The handle in each case of the prior art can be fluidly coupled to a vacuum source of any design. Additionally, the prior art discloses a broom head that has a vacuum unit integrated therein.

BRIEF SUMMARY OF THE INVENTION

An embodiment of the disclosure meets the needs presented above by generally comprising a vacuum pack that is wearable on a user's back. The vacuum pack has an intake for urging air inwardly therein when the vacuum pack is turned on and a suction hose is fluidly coupled to the intake. A broom is provided that has a head and a handle. A suction manifold is coupled to the broom and the suction manifold has a pair of inlet ports and an exhaust port. The suction hose is fluidly coupled to the exhaust port such that the suction manifold is in fluid communication with the vacuum unit. Each of the inlet ports is aligned with the head of the broom for sucking up debris that is produced from sweeping. In this way the vacuum unit reduces airborne particles produced from sweeping.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
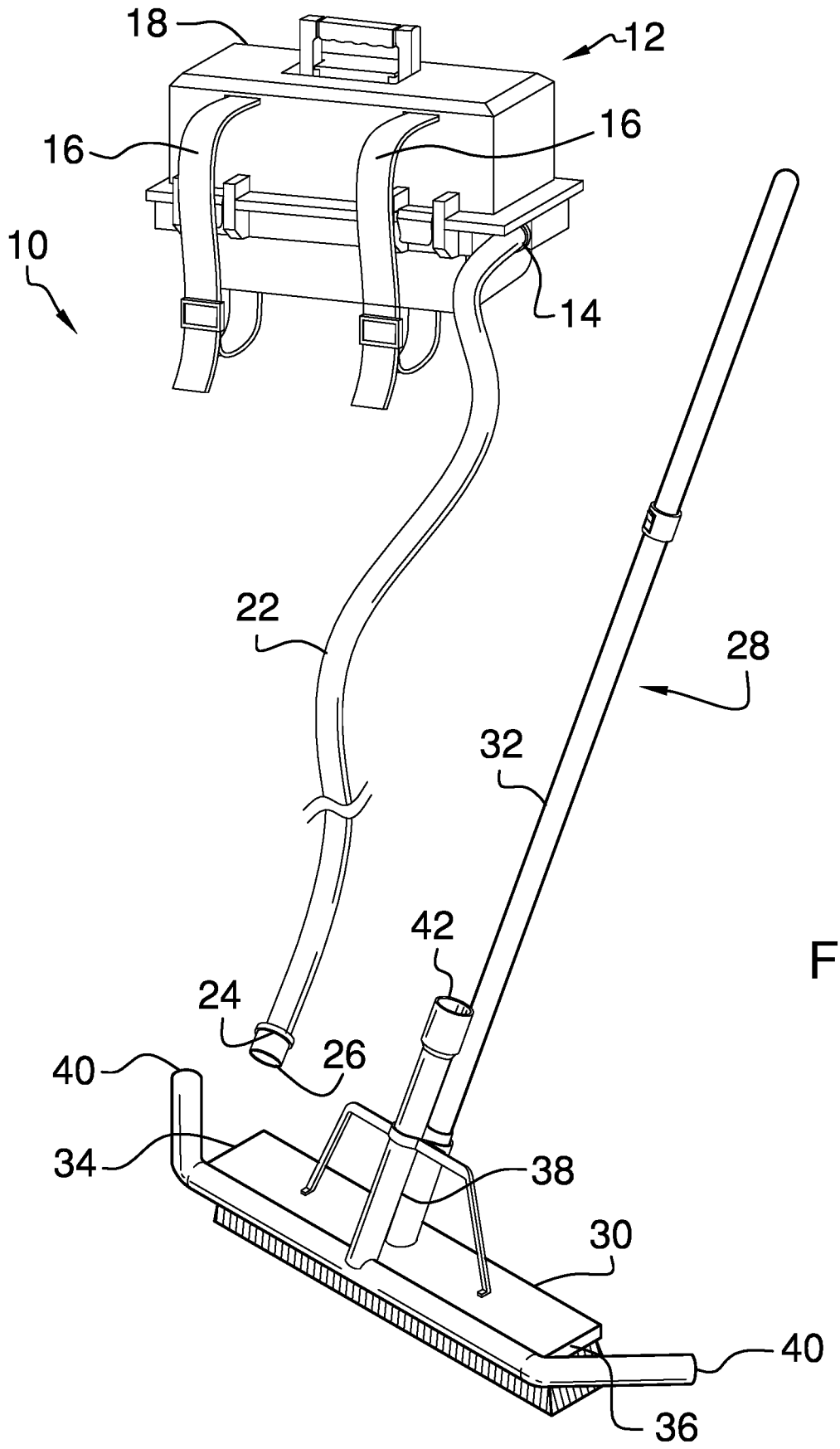
FIG. 1 is a perspective view of a vacuuming broom assembly according to an embodiment of the disclosure.
Figure 2:
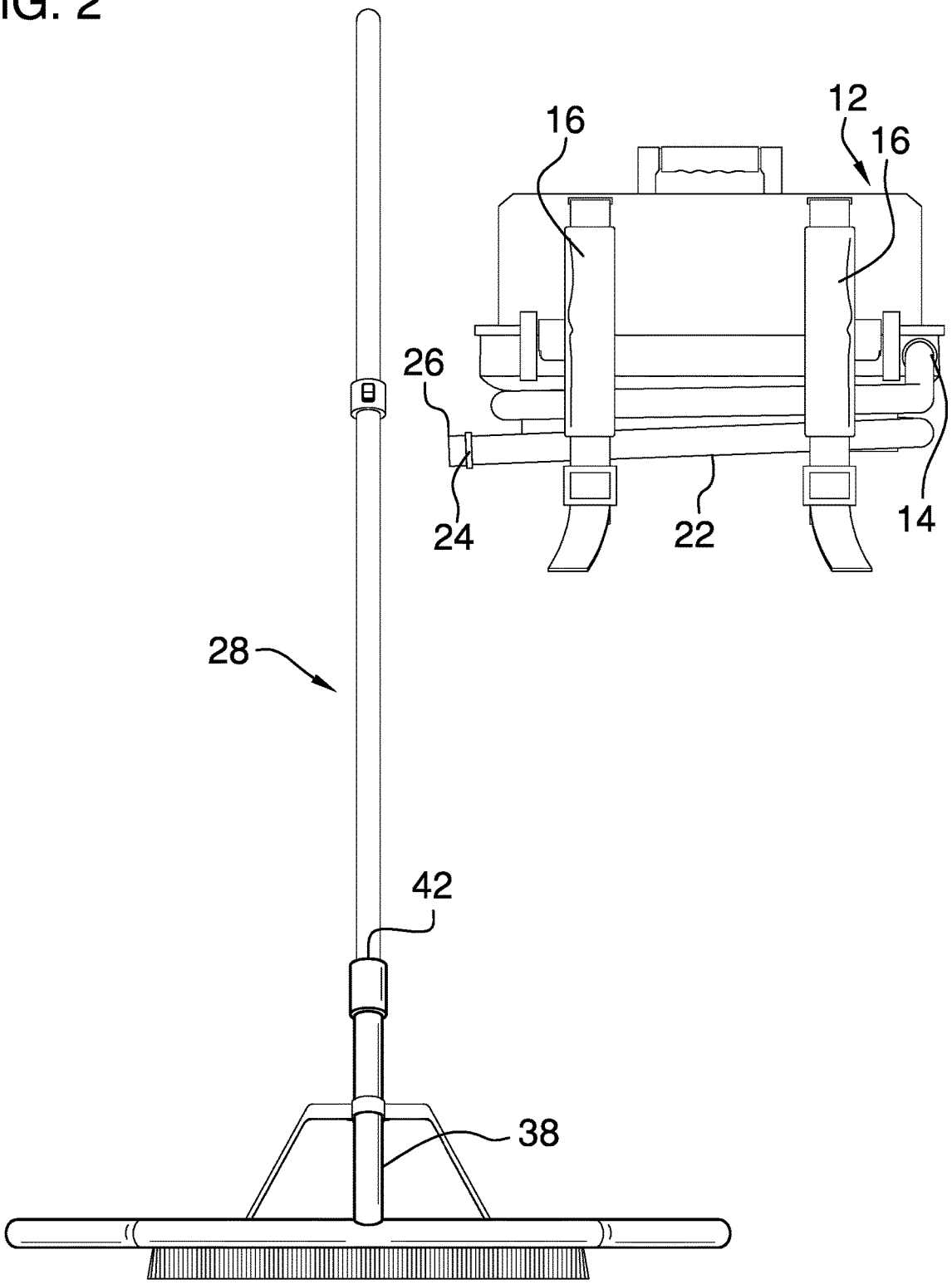
FIG. 2 is a front view of an embodiment of the disclosure.
Figure 3:
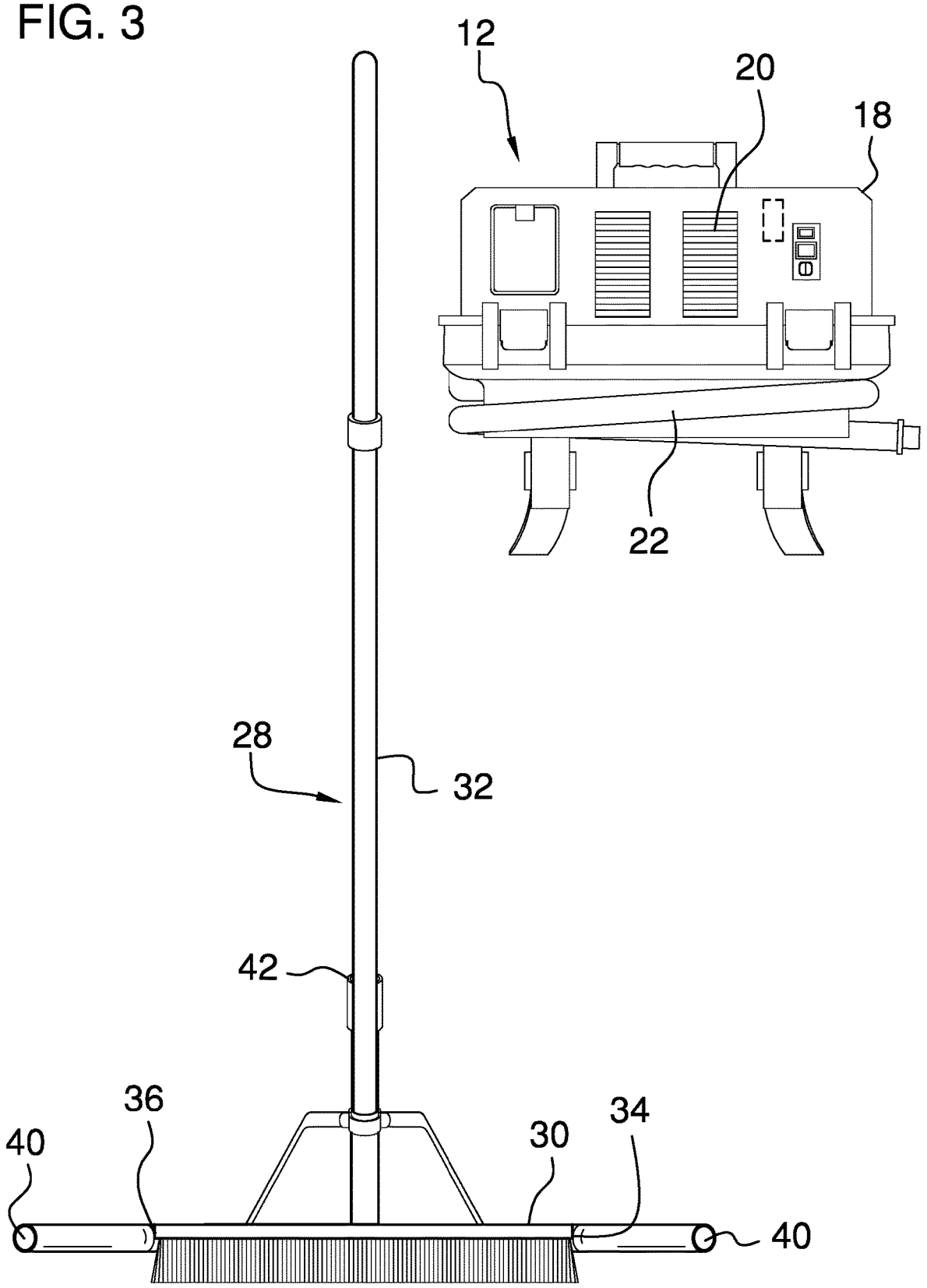
FIG. 3 is a back view of an embodiment of the disclosure.
Figure 4:
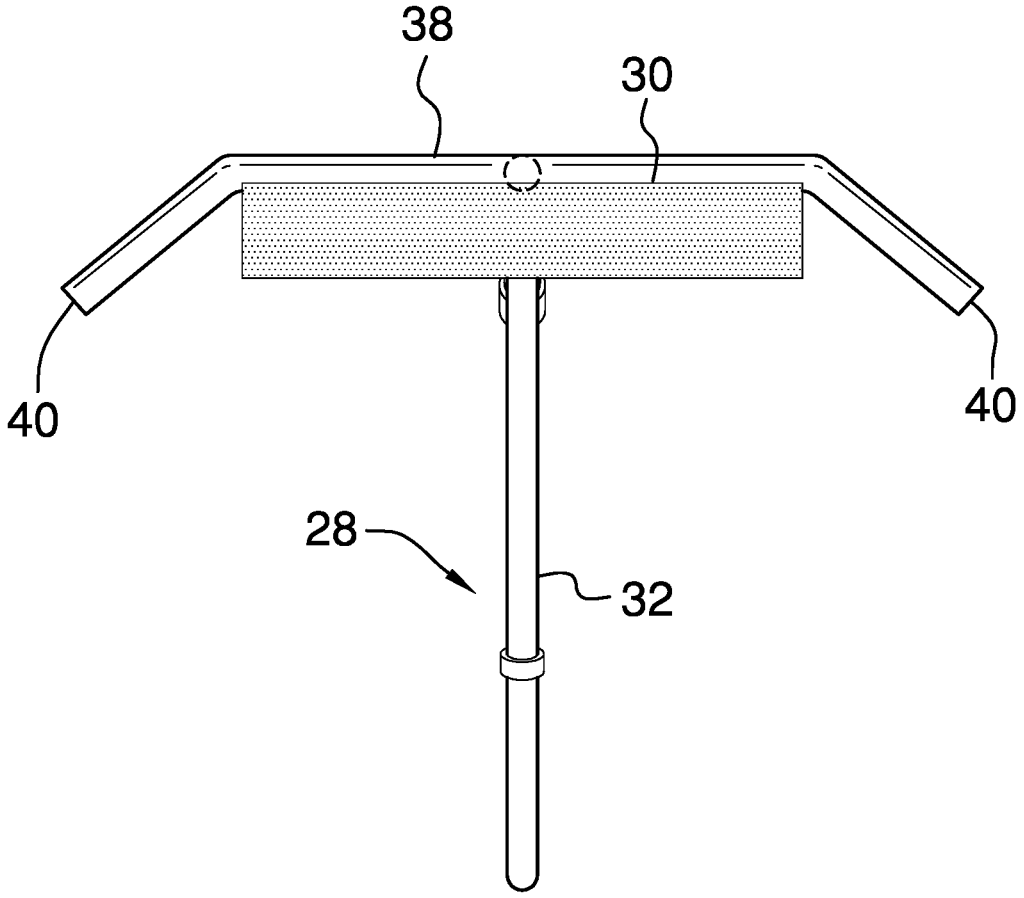
FIG. 4 is a bottom view of a broom of an embodiment of the disclosure.
Figure 5:
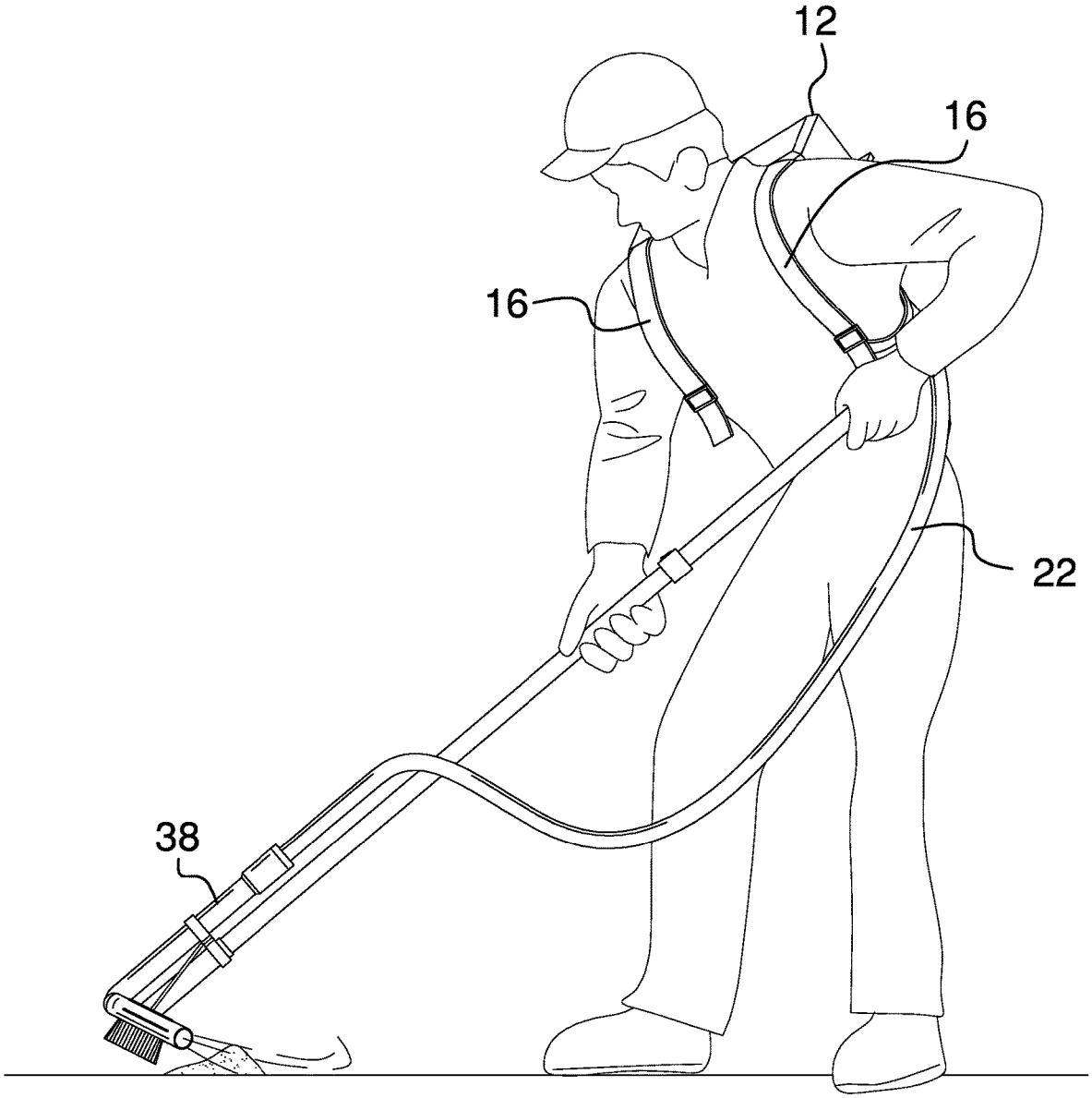
FIG. 5 is a perspective in-use view of an embodiment of the disclosure.

With reference now to the drawings, and in particular to FIGS. 1 through 5 thereof, a new vacuuming device embodying the principles and concepts of an embodiment of the disclosure and generally designated by the reference numeral 10 will be described.

As best illustrated in FIGS. 1 through 5, the vacuuming broom assembly 10 generally comprises a vacuum pack 12 that is wearable on a user's back. The vacuum pack 12 has an intake 14 for urging air inwardly therein when the vacuum pack 12 is turned on. Additionally, the vacuum pack 12 includes a pair of shoulder straps 16 that is each wearable over the user's shoulders for wearing the vacuum pack 12. The vacuum pack 12 may include a housing 18 with a hinged lid and an electric vacuum 20 that is positioned inside the housing 18. The electric vacuum 20 may include a hepa filter and the electric vacuum 20 may be fluidly coupled to the intake 14. Additionally, the vacuum pack 12 includes a rechargeable battery for operation thereby eliminating the need for a power cord.

A suction hose 22 is provided and the suction hose 22 is fluidly coupled to the intake 14 on the vacuum pack 12. Thus, the suction hose 22 sucks air inwardly therein when the vacuum pack 12 is turned on. The suction hose 22 has a distal end 24 with respect to the intake 14 and the distal end 24 has a coupler 26 thereon. The suction hose 22 may have a length ranging between approximately 5.0 feet and 7.0 feet.

A broom 28 is included that has a head 30 and a handle 32. The head 30 is elongated along an axis extending between a first end 34 and a second end 36 of the head 30. The broom 28 may comprise a shop broom of any convention size or design. A suction manifold 38 is coupled to the broom 28 and the suction manifold 38 has a pair of inlet ports 40 and an exhaust port 42. The suction hose 22 is fluidly coupled to the exhaust port 42 such that the suction manifold 38 is in fluid communication with the vacuum pack 12.

The suction manifold 38 is coupled to the broom 28 and each of the inlet ports 40 is aligned with the head 30 for sucking up debris that is produced from sweeping. In this way the vacuum pack 12 can reduce airborne particles produced from sweeping. Each of the inlet ports 40 is aligned with a respective one of the first end 34 and the second end 36 of the head 30. Additionally, each of the inlet ports 40 angles rearwardly away from the respective first end 34 and the second end 36. The exhaust port 42 is positioned on the handle 32 and the exhaust port 42 is directed upwardly from the head 30. The exhaust port 42 insertably receives the coupler 26 on the distal end 24 of the suction hose 22.

In use, the vacuum pack 12 is worn on the user's back and the suction hose 22 is plugged into the suction manifold 38. The vacuum pack 12 is turned on and the broom 28 is employed to sweep an area, such as a construction site or other area that would likely produce a large amount of airborne particles from sweeping. Thus, the vacuum pack 12 vacuums the debris as the broom 28 sweeps, thereby reducing the airborne particles. In this way the vacuum pack 12 lowers the risk of exposure to airborne silica particles and other hazardous material for workers in the area that is being swept.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A vacuuming broom assembly being configured to vacuum debris swept by a broom thereby reducing airborne particles that commonly result from sweeping, said assembly comprising:

a vacuum pack being wearable on a user's back, said vacuum pack having an intake for urging air inwardly therein when said vacuum pack is turned on;

a suction hose being fluidly coupled to said intake on said vacuum pack wherein said suction hose is configured to suck air inwardly therein when said vacuum pack is turned on, said suction hose having a distal end with respect to said intake, said distal end having a coupler thereon;

a broom having a head and a handle, said head being elongated along an axis extending between a first end and a second end of said head; and a suction manifold being coupled to said broom, said suction manifold having a pair of inlet ports and an exhaust port, said exhaust port having said suction hose being fluidly coupled thereto such that said suction manifold is in fluid communication with said vacuum unit, said suction manifold being coupled to said broom, each of said inlet ports being aligned with said head for sucking up debris that is produced from sweeping wherein said vacuum unit is configured to reduce airborne particles produced from sweeping, each of said inlet ports being spaced laterally away from one of said first end and said second end of said head, each of said inlet ports facing rearwardly and laterally away from said head.

2. The assembly according to claim 1, wherein said vacuum pack includes a pair of shoulder straps, each of said shoulder straps being wearable over the user's shoulders for wearing said vacuum pack.

3. The assembly according to claim 1, wherein said exhaust port is positioned on said handle, said exhaust port being directed upwardly from said head, said exhaust port insertably receiving said coupler on said distal end of said suction hose.

4. A vacuuming broom assembly being configured to vacuum debris swept by a broom thereby reducing airborne particles that commonly result from sweeping, said assembly comprising:

a vacuum pack being wearable on a user's back, said vacuum pack having an intake for urging air inwardly therein when said vacuum pack is turned on, said vacuum pack including a pair of shoulder straps, each of said shoulder straps being wearable over the user's shoulders for wearing said vacuum pack;

a suction hose being fluidly coupled to said intake on said vacuum pack wherein said suction hose is configured to suck air inwardly therein when said vacuum pack is turned on, said suction hose having a distal end with respect to said intake, said distal end having a coupler thereon;

a broom having a head and a handle, said head being elongated along an axis extending between a first end and a second end of said head;

a suction manifold being coupled to said broom, said suction manifold having a pair of inlet ports and an exhaust port, said exhaust port having said suction hose being fluidly coupled thereto such that said suction manifold is in fluid communication with said vacuum unit, said suction manifold being coupled to said broom, each of said inlet ports being aligned with said head for sucking up debris that is produced from sweeping wherein said vacuum unit is configured to reduce airborne particles produced from sweeping, each of said inlet ports being spaced laterally away from one of said first end and said second end of said head, each of said inlet ports facing rearwardly and laterally away from said head, said exhaust port being positioned on said handle, said exhaust port being directed upwardly from said head, said exhaust port insertably receiving said coupler on said distal end of said suction hose.

* * * * *